United States Patent [19]

Ko et al.

[11] Patent Number: 4,689,609

[45] Date of Patent: Aug. 25, 1987

[54] ELECTRONIC HORN WITH SPIRAL DEFLECTING WALLS COUPLED TO A TRUNCATED CONE STRUCTURE

[76] Inventors: Clyde M. A. Ko, Derby #1, R. #1, Box 24, Reed City, Mich. 49677; Darrel A. Dolph, 604 Marion St., Big Rapids, Mich. 49307

[21] Appl. No.: 804,544

[22] Filed: Dec. 4, 1985

[51] Int. Cl.[4] ..... G10K 9/12; G08B 3/00

[52] U.S. Cl. ..... 340/38.4 E; 181/143; 181/191; 181/193; 340/384 R; 340/388; 381/156

[58] Field of Search ..... 340/384 R, 384 E, 388, 340/393, 404; 116/59, 137 R, 142 R, 142 FP, 140; 179/115.5 R, 115.5 H; 181/160, 159, 177, 181, 182, 184, 185, 187, 191, 193, 143, 152; 310/324; 381/86, 156

[56] References Cited

U.S. PATENT DOCUMENTS

| | | | |
|---|---|---|---|
| 1,637,322 | 7/1927 | Weil | 181/160 |
| 2,310,243 | 2/1943 | Klipsch | 181/152 |
| 3,477,405 | 11/1969 | Jensen | 340/388 |
| 3,493,966 | 2/1970 | Human | 340/384 E |
| 3,846,792 | 11/1974 | Haigh | 340/388 |
| 3,886,546 | 5/1975 | Ueda | 181/193 |
| 3,917,024 | 11/1975 | Kaiser, Jr. | 181/160 |
| 4,204,200 | 5/1980 | Beyl, Jr. | 340/384 R |
| 4,293,851 | 10/1981 | Beyl, Jr. | 340/384 E |
| 4,325,456 | 4/1982 | Ureda | 181/159 |
| 4,486,742 | 12/1984 | Kudo et al. | 340/388 |
| 4,558,305 | 12/1985 | Black et al. | 340/384 R |

FOREIGN PATENT DOCUMENTS

| | | | |
|---|---|---|---|
| 2389961 | 1/1979 | France | 181/193 |

*Primary Examiner*—James L. Rowland
*Assistant Examiner*—Brent A. Swarthout
*Attorney, Agent, or Firm*—Watts, Hoffmann, Fisher & Heinke Co.

[57] ABSTRACT

An electronic horn of compact dimensions. Oscillator circuits coupled to a mixing node produce a multiple frequency signal used to drive a horn transducer. One horn replaces the two horns used in the prior art. A reverberating chamber in close proximity to the transducer includes a cone shaped structure having multiple spiraling reflecting walls connected to the convex surface of the cone. Sound waves emitted by the transducer reverberate within the chamber as they bounce off the reflecting walls.

5 Claims, 6 Drawing Figures

ELECTRONIC HORN WITH SPIRAL DEFLECTING WALLS COUPLED TO A TRUNCATED CONE STRUCTURE

DESCRIPTION

1. Technical Field

The present invention relates to an electronic horn particularly suited for use in a motor vehicle.

2. Background Art

Prior art motor vehicle horns often utilize two horns, with each horn producing a different pitch output, so that the combined output of the horns produces a desired sound. Use of two physically separate horns requires allocation of space beneath the hood for both horns.

The size of the horn dictates how much space the automobile manufacturer must allocate for the horn beneath the automobile hood. Prior art horns resemble a musical horn having a flared end that opens outward as sound waves reverberate in the horn. The flared opening enhances certain frequency harmonics while attenuating other frequencies to produce a sound having a characteristic pitch. The flared horn end takes up additional space, however, a commodity in short supply in a motor vehicle engine compartment.

3. Disclosure of the Invention

The present invention addresses the need for a multiple pitch horn while reducing the size of the horn. The space the horn occupies is reduced by use of one horn that accomplishes the task requiring two horns in the prior art.

The disclosed horn generates a sound at the frequency of an oscillating electric signal by means of a transducer that converts the oscillating signal into mechanical movement. This creates sound waves of the requisite pitch. The mechanical transducer is enclosed in proximity to a sound chamber so that the transducer directs sound waves into the chamber. A sound reflector causes sound to reverberate within the chamber. The reflector defines a truncated cone having an aperture in the middle and a plurality of deflecting walls coupled to a convex surface of the cone with each wall spiraling outward from a point adjacent the aperture down the convex surface of the cone.

Mechanical sound waves generated by the transducer enter the sound chamber via the aperture in the truncated cone and reverberate or reflect off the spiral walls. The spiral reflecting walls form a reverberation chamber having an effect similar to the expanding walls of a prior art horn. The size requirements of the present sound chamber, however, are less than an equivalent prior art horn.

An input to the horn is generated by a multiple pitch generating circuit including a plurality of oscillator circuits, each producing a characteristic frequency signal. These circuits are coupled to a mixing node which in turn is coupled to a splitter circuit. The splitter circuit provides a positive and negative oscillating signal relative a reference level. An output from the splitter circuit is amplified and coupled to the horn transducer. The splitter circuit produces a combination signal having two characteristic frequencies to accomplish with one signal what was accomplished with two horns in the prior art. In a preferred embodiment of the design, the horn circuit includes more than two oscillator circuits, each having separate control inputs, so that the characteristic pitch combinations of the horn can be controlled.

From the above, it is appreciated that one object of the invention is a new and improved horn that requires less space and can approximate outputs achieved through use of separate horns in the art. This and other objects, advantages and features of the invention will become better understood when a detailed description of a preferred embodiment of the horn is described in conjunction with the accompanying drawings.

BEST MODE FOR CARRYING OUT THE INVENTION

Figure 1:
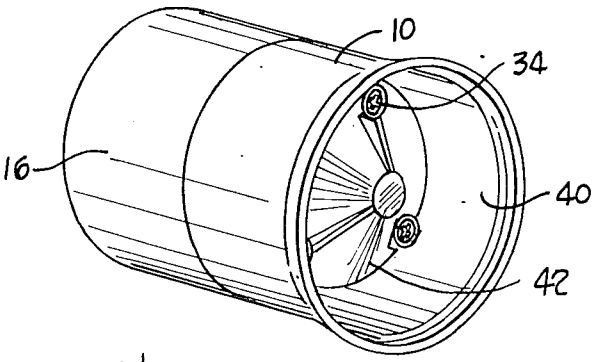
FIG. 1 is a perspective view of an electronic horn constructed in accordance with the invention.

Turning now to the drawings, FIG. 1 illustrates a horn 10 constructed in accordance with the invention. The horn has compact physical dimensions with a length L (FIG. 2) of approximately 9 centimeters and a diameter D of approximately 8 centimeters. Two inputs 12 couple horn energizing signals to the horn 10 from circuitry (FIGS. 4–6) that provide a multiple pitch signal. When used to energize the horn 10 this signal produces an output similar to the sound produced by two separate horns in the prior art.

Figure 2:
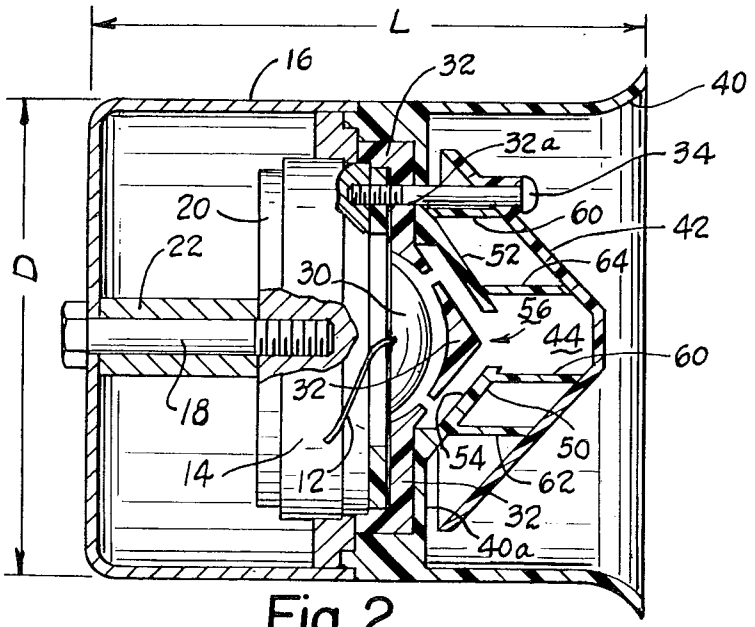
FIG. 2 is a partially sectioned, enlarged view of the electronic horn.
Figure 3:
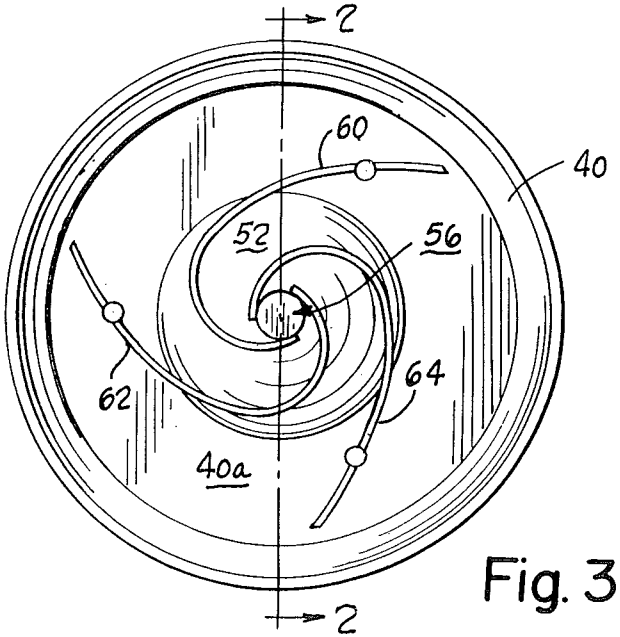
FIG. 3 is an end elevation view of a horn reverberating chamber.

The partially sectioned view of the horn 10 in FIG. 2 illustrates a horn magnet 14 mounted within a housing 16 by a threaded connector 18 engaging a magnet support 20. The position of the magnet 14 within the housing 16 is fixed by a spacer 22 that slips over the connector 18.

Coaxial with and symmetric to the threaded connector 18, the magnet 14 defines a coil gap (not shown) that receives a conductive coil coupled to a horn diaphragm 30. Energization of the coil via the inputs 12 sets up currents within the coil which interact with the magnetic field within the coil gap causing the coil to move back and forth within the gap. This in turn causes a movement of the diaphragm 30 which sets up sound waves at the frequency of diaphragm oscillation.

A diaphragm cover 32 is supported by the magnet by threaded connectors 34 extending through openings **32*a* in the cover. The diaphragm cover 32 engages a gasket (not shown) interposed between the cover 32 and diaphragm 30**.

In addition to securing the diaphragm cover over the diaphragm, the connectors 34 couple a horn member 40 and sound reflector 42 to the housing 16. The reflector 42 and diaphragm cover 32 define a sound chamber 44 in proximity to the diaphragm 30. Sound waves set up by oscillation of the diaphragm are emitted from the diaphragm and pass the diaphragm cover to a region of a cone shaped element 50 formed in the horn member 40. The cone shaped element 50 includes concave and convex surfaces 52, 54 and a center aperture 56 coaxial with the cone.

Also forming an integral part of the horn member 40 are three spiraling reflecting walls 60, 62, 64. Sound waves from the diaphragm 30 reflect off the sound reflector 42 and are channeled back along the convex surface 52 of the cone 50 by these relfecting walls 60, 62, 64. As the walls spiral away from the center aperture, the spacing between adjacent walls increases. The spiraling walls 60, 62, 64 extend to and across a substantially planar portion 40*a* of the horn member 40. A sound wave reverberation is produced without the necessity of the bell shaped structure utilized in prior art horns.

The sound relfector 42 is also substantially conical in shape but does not include a center aperture as does the cone 50 of the horn member 40. The sound reflector includes a symmetric arrangement of three apertures through which the connectors 34 extend to hold the horn member 40 in place.

Figure 4:
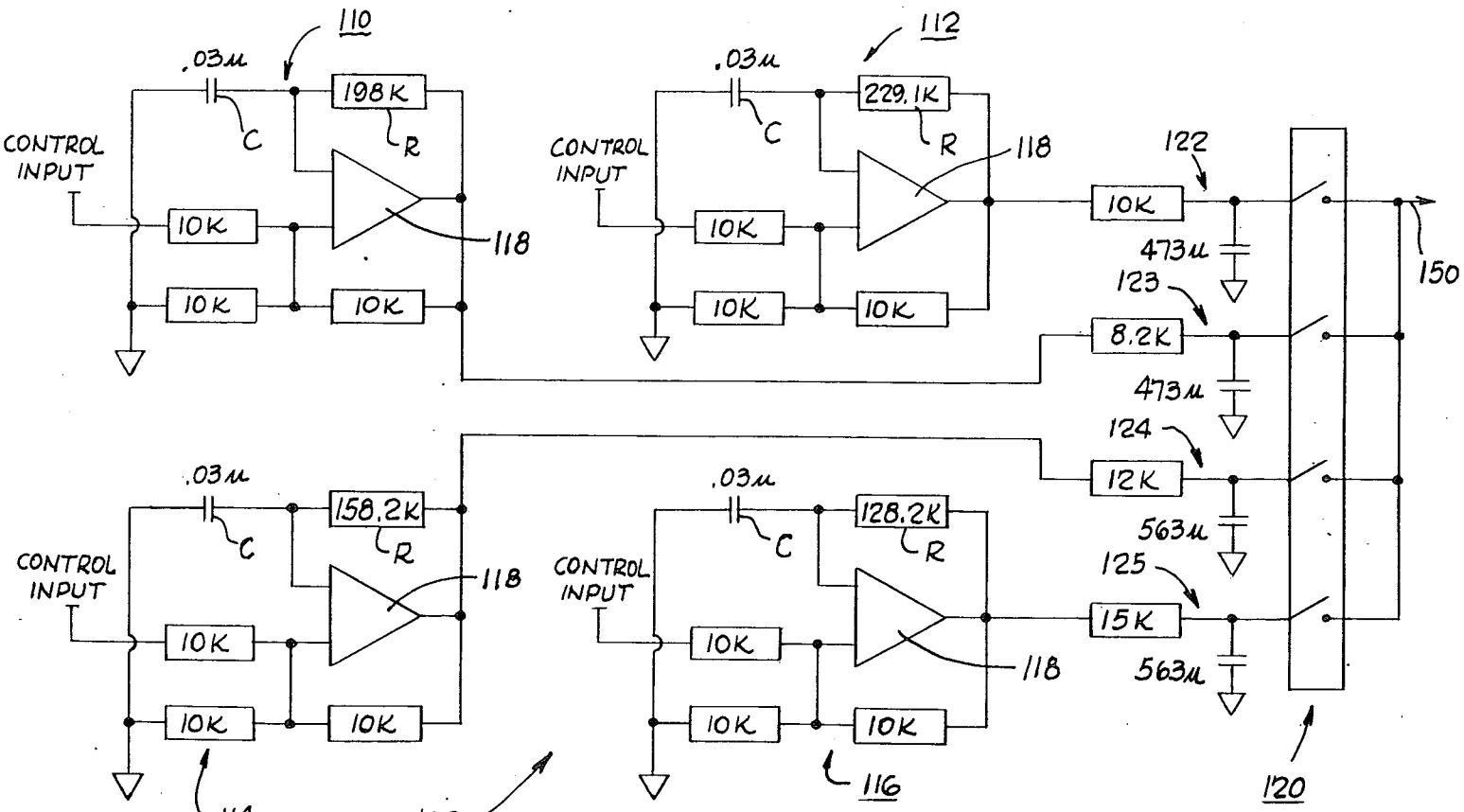
FIG. 4 is an oscillator circuit for generating different pitch horn energization signals.
Figure 5:
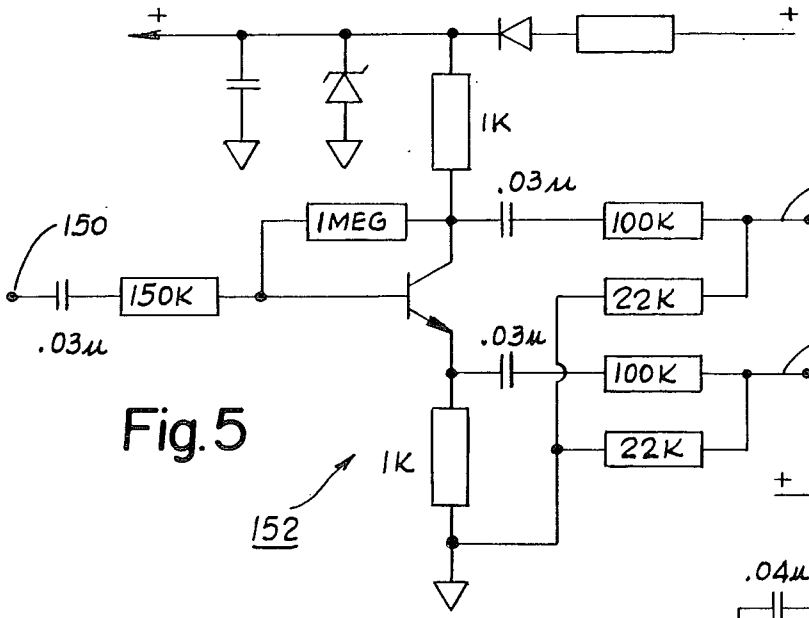
FIG. 5 is a splitter circuit for generating two signals from a single output from the FIG. 4 oscillator circuit.

An oscillator circuit 100 for generating electrical signals to drive the horn diaphragm 30 is depicted in FIG. 4. The circuit 100 includes four separate oscillators 110, 112, 114, 116. Each of these oscillators includes a control switch 120 for selectively activating the associated oscillator.

The oscillating circuits are constructed using operational amplifiers 118 which upon receipt of a control input oscillate with a characteristic frequency. Each of the oscillator circuits is coupled to an associated filter 122–125 which transforms the square wave output from the oscillator into a saw tooth waveform. An output from each filter 122–125 is then coupled to a mixing node 150 connected to a conventional splitter circuit 152 depicted in FIG. 5.

Figure 6:
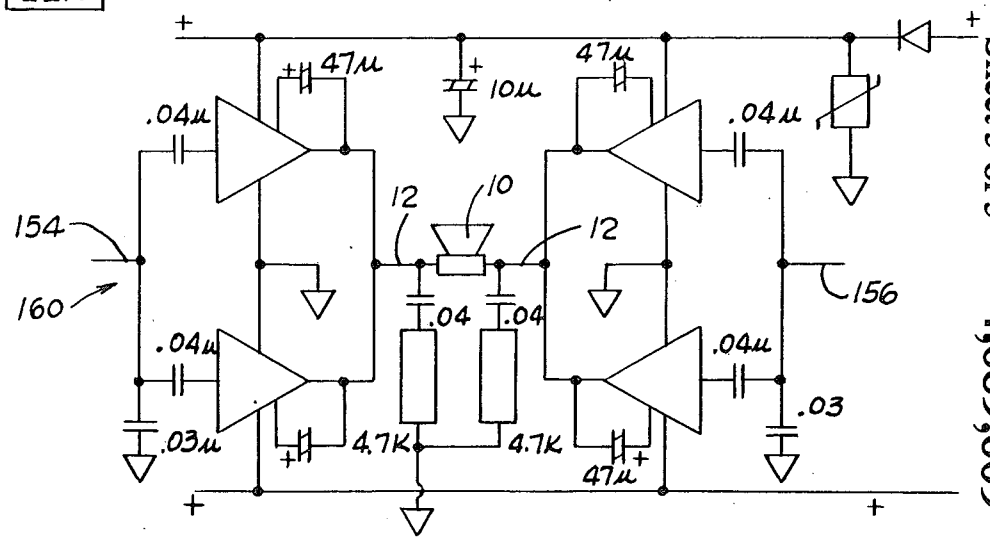
FIG. 6 is a amplifier circuit for the horn.

The splitter circuit 152 provides two outputs 154, 156. A first of these outputs 154 mirrors the input to the splitter 152 to provide an oscillating saw tooth wave form having a frequency determined by the oscillator configuration connected to the mixing node 150. An inverse wave form, symmetric with respect to the first wave form about a reference voltage is produced by the second output 156. These two signals are in turn coupled to a conventional bridge amplifier 160 (FIG. 6). The bridge amplifier amplifies the voltage difference of the two wave forms genrated by the splitter circuit 152 and connects this amplified signal across the horn inputs 12 to energize the horn coil with a signal of an appropriate frequency mix.

Sound waves emitted by the diaphragm 30 travel past the diaphragm cover and reverberate in the chamber 44 defined by the reflector 42 and cone 50. The frequency is a combination of the frequencies from the oscillator circuits 110, 112, 114, 116 that approximate the sound produced by separate horns.

The present horn has been described with a degree of particularity. It is the intent, however, that the invention include all modifications and alterations from the disclosed preferred embodiment falling within the spirit or scope of the appended claims.

We claim:

1. A horn for generating a sound when energized with an oscillating electric signal comprising:

transducer means for converting said oscillating electric signal into a mechanical movement to create sound waves which emanate from the transducer means;

housing means for supporting said transducer means; and sound chamber defining means coupled to and supported by the housing means in proximity to the transducer means for causing the sound waves emmanating from the transducer means to reverberate within a sound chamber, said sound chamber defining means including a truncated cone member spaced from the transducer means and having an aperture in the middle, a plurality of deflecting walls coupled to a convex surface of the truncated cone that spiral outward from a point adjacent the aperture along the convex surface of the cone, and a sound reflector having a concave surface spaced from the truncated cone by the deflecting walls for reflecting sound emmanating from the transducer means that passes through the aperture outward along the convex surface of the truncated cone in multiple regions between the deflecting walls.

2. The horn of claim 1 where the deflecting walls have a greater height near the aperture and decrease in height as they spiral out from the aperture along the convex surface of the truncated cone.

3. The horn of claim 1 where the sound chamber defining means includes a planar member that abuts a bottom of the truncated cone and the deflecting walls spiral beyond the convex surface of the cone to extend onto the planar member.

4. The horn of claim 1 additionally comprising circuit means for energizing the transducer means, said circuit means including a plurality of oscillator circuits and means to combine outputs from the oscillator circuits to provide a multi-pitch oscillating electric signal to energize the transducer means.

5. The horn circuit of claim 4 where each of said oscillator circuits has a control input to render a selected combination of said oscillator circuits active to provide a specific mixing of characteristic frequencies.

* * * * *